US005660257A

United States Patent [19]

Douglas

[11] Patent Number: 5,660,257

[45] Date of Patent: Aug. 26, 1997

[54] AEROBIC STEP CASE

[75] Inventor: Nancy Douglas, Madisonville, Ky.

[73] Assignee: Richard T. Holzmann, Danbury, Conn.

[21] Appl. No.: 953,179

[22] Filed: Sep. 29, 1992

[51] Int. Cl.[6] ..... A45C 9/00

[52] U.S. Cl. ..... 190/1; 206/315.1; 482/52

[58] Field of Search ..... 206/315.1, 579; 190/1; 150/158, 154; 482/52, 83, 148

[56] References Cited

U.S. PATENT DOCUMENTS

| | | | |
|---|---|---|---|
| 4,113,161 | 9/1978 | Manuszak | 190/1 X |
| 4,337,861 | 7/1982 | Smart | 206/579 |
| 4,702,029 | 10/1987 | DeVaul et al. | 42/94 |
| 5,062,557 | 11/1991 | Mahvi et al. . | |
| 5,084,321 | 1/1992 | Sui | 150/158 X |
| 5,096,186 | 3/1992 | Wilkinson et al. | 482/52 |
| 5,120,069 | 6/1992 | Shaw | 206/315.1 X |
| 5,140,833 | 8/1992 | Whalen | 150/154 X |
| 5,143,133 | 9/1992 | Speckman | 150/158 |
| 5,184,987 | 2/1993 | Wilkinson | 482/52 |
| 5,213,554 | 5/1993 | Goldstein et al. | 482/52 |
| 5,474,509 | 12/1995 | Hodgdon | 485/52 |

*Primary Examiner*—Allan N. Shoap
*Assistant Examiner*—Christopher McDonald
*Attorney, Agent, or Firm*—Richard T. Holzmann

[57] ABSTRACT

An aerobic step incorporated as an integral part of a carrying case, having its platform as an outer surface thereof, which case having thereby sufficient internal volume for carrying personal items and other belongings, thereby eliminating the need for carrying two items using the aerobic step case for both purposes. The case being formed by attaching to the step flexible fabric material of the type normally employed in tote bags and soft suitcases. The means for attachment being of several types depending upon the end use of the case, that is, by adhesives, staples, snap-on fasteners or the like. The flexible material further comprises a handle and slide fastener for opening and closing. Other embodiments comprising rigid container portions with an end open for attachment to the aerobic step by hinges or other means so constructed and arranged to substitute for a typical cosmetic case or suitcase used in traveling.

3 Claims, 2 Drawing Sheets

AEROBIC STEP CASE

BACKGROUND OF THE INVENTION

1. Field of the Invention

This invention relates to an aerobic step article which is an integral element of a case for its carrying whereby the need for two pieces of luggage or carrying bags is reduced to one. An aerobic step as used in this invention is also known as a stair exerciser, a step stair climber or an aerobics stepper. The top surface of the step, the platform, is one of the outside surfaces of the case, the other outer surfaces being made of flexible cloth-like fabric material commonly used for existing carrying and traveling bags. The method of attachment of the flexible material can be by means of removable or permanent fasteners, or locked in place with an adhesive. In a tote-bag version, the length of the legs of the stepper would determine the internal volume of the bag available for the packing of personal items and other gear. A handle is attached to one of the longer sides, while the side opposite the surface of the step would comprise a U-shaped zipper or slide fastener allowing the opening and closing of the case when not in use as an aerobic step. Such an aerobic step case would normally weigh less than 10 pounds.

2. The Prior Art

There are a number of aerobic steps currently available and in use by fitness enthusiasts. These steps are an important element of fitness training programs which have been demonstrated to tighten and tone hips, thighs and buttocks, and to effectively be a vehicle for burning body fat. A typical available stepper allows one to adjust the height thereof from 4 to 6 to 8 to 10 inches by simply sliding specially grooved legs into the bottom of the platform eliminating the need for extra blocks. These articles usually require no more than 30×18 inches of floor space.

Several available versions have shock-absorbing, non-slip platforms that require merely a step-on, step-off procedure, providing one with the same high intensity aerobic benefits as jogging with the low-impact stress of walking.

Other available steppers are more complex in that rather than being a simple step, they consist of a fluid-filled hydraulic system which provides a smooth stepping action and variable resistance. In these systems, the fluid in the hydraulically actuated pedals moves from one hydraulic chamber to the other in a quiet, non-jarring motion. A control tab allows one to adjust the amount of fluid that circulates, increasing or decreasing the stepper's resistance. These sytems are usually made of aircraft-grade cast aluminum rather that the durable, high molecular injection molded heavy-duty polyethylene of the simpler versions and usually weigh in excess of 15 pounds not including any case for its carrying.

SUMMARY OF THE INVENTION

This invention allows the traveler to benefit from an aerobic step workout away from home without the inconvenience associated with the carrying of a separate piece of equipment. For the person who carries his or her aerobic step to a class at a gym, this invention would allow the person to carry only one thing, a modified tote-bag. This aerobic step case can be packed with personal items and other gear as with any ordinary tote-bag, cosmetic case or suitcase. These latter features in particular solving the problem of being able to workout, when traveling, in the privacy of one's hotel room, for example.

The basic feature of this invention is that an aerobic step becomes an integral part of a case for its carrying. However, this is not merely for the carrying of the step itself, but rather for the ability to carry other personal items and gear in the same bag and thereby reducing the two pieces of equipment to be carried, that is, the step and a tote bag, for example, to the one. Another embodiment is designed for use by the longer distance traveler, that is, not the one going to a local gym, but the person who might be traveling by air or train and would normally be carrying a suitcase or a cosmetic case.

By attaching to the aerobic step a fabric material of the type normally used for a flexible piece of luggage, the platform of the step becomes one surface of the case and the configuration of the step determines either the overall volume of the case, or when a larger volume is required for more distant travel, while the platform is still a surface of the case, rather than being a side surface, it may be the bottom or top surface.

Any conventional means may be used for attachment purposes, either permanent or temporary. In the former, an adhesive or staple type fastener may be used, in the latter, snap-on and -off fasteners may be employed. The application will determine the kind of fastening. For inexpensive and simple use as with a tote bag for local travel, the fastening may be permanent in which case the fabric will need to be configured so that it can fold under, in back of or away from the step to allow easy and safe access to the platform for stepping. For use in a cosmetic case or suitcase configuration, the fabric can be attached by snaps or other sturdy fastener type which will permit complete removal of the fabric.

Other features of the invention include a handle for carrying attached to the fabric portion in a suitable location, and a zipper or other slide fastener for opening the case on the side opposite the platform side in the tote bag or cosmetic case configuration. In another embodiment, the surface of the platform may be protected when in transit with a sheet of outer fabric attached with the hook and eye type of fastening commonly sold under the trademark VELCRO. This sheet of outer fabric might be that piece enclosed within the track of the zipper or slide fastener in an oval or elliptical rather than U-shaped configuration.

BRIEF DESCRIPTION OF THE DRAWINGS

The invention of the present application will now be described in more detail with reference to the preferred embodiments of the article, given only by way of example, and with reference to the accompanying drawings, in which:

FIG. 5 is a schematic view of the stepcase of FIG. 4 with the aerobic step platform in the use position and with the flexible fabric folded under and back;

FIG. 6 is a schematic view of another embodiment of the stepcase with the flexible fabric in place creating a tote bag with a larger available space for storage;

FIG. 7 is a schematic view of yet another embodiment with the stepcase being of the removable or non-removable cosmetic case-type configuration; and FIG. 8 is a schematic view of the stepcase constructed so that the aerobic step is a removable part of a larger suitcase.

DESCRIPTION OF THE PREFERRED EMBODIMENTS

Figure 1:
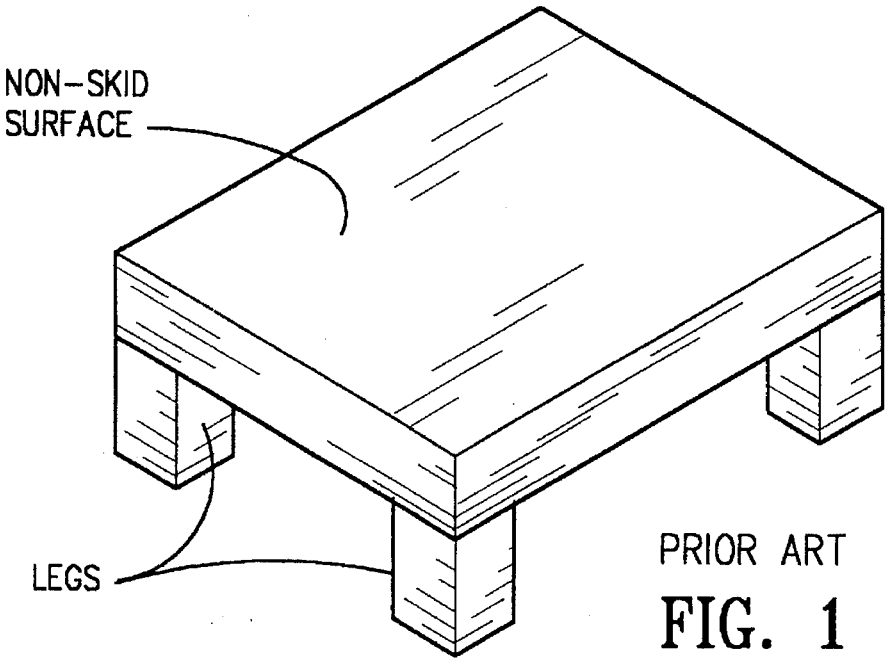
PRIOR ART FIG. 1
FIG. 1 is a schematic view of a conventional aerobic step.
Figure 2:
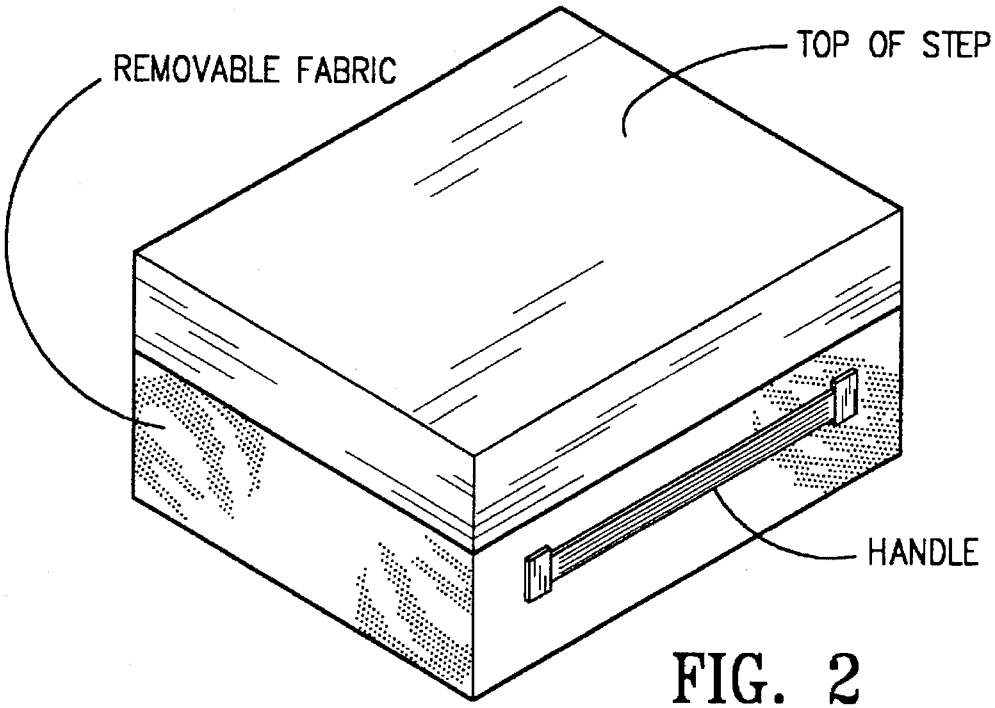
FIG. 2 is a schematic view of the aerobic step with the fabric in place thereby creating the case with a handle attached thereto.
Figure 3:
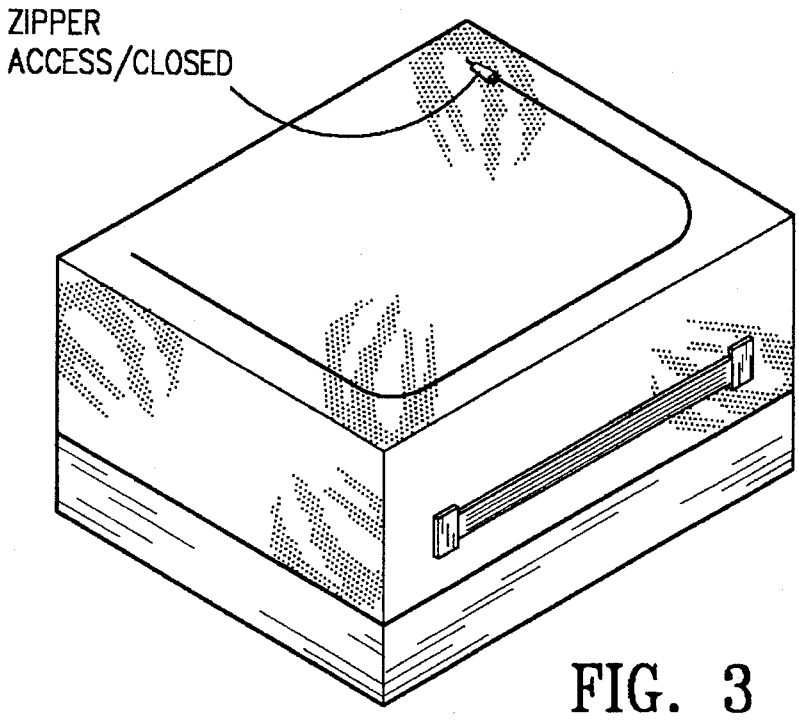
FIG. 3 is a schematic view of the aerobic step case, right side up showing the slide fastener for access in the closed position.
Figure 4:
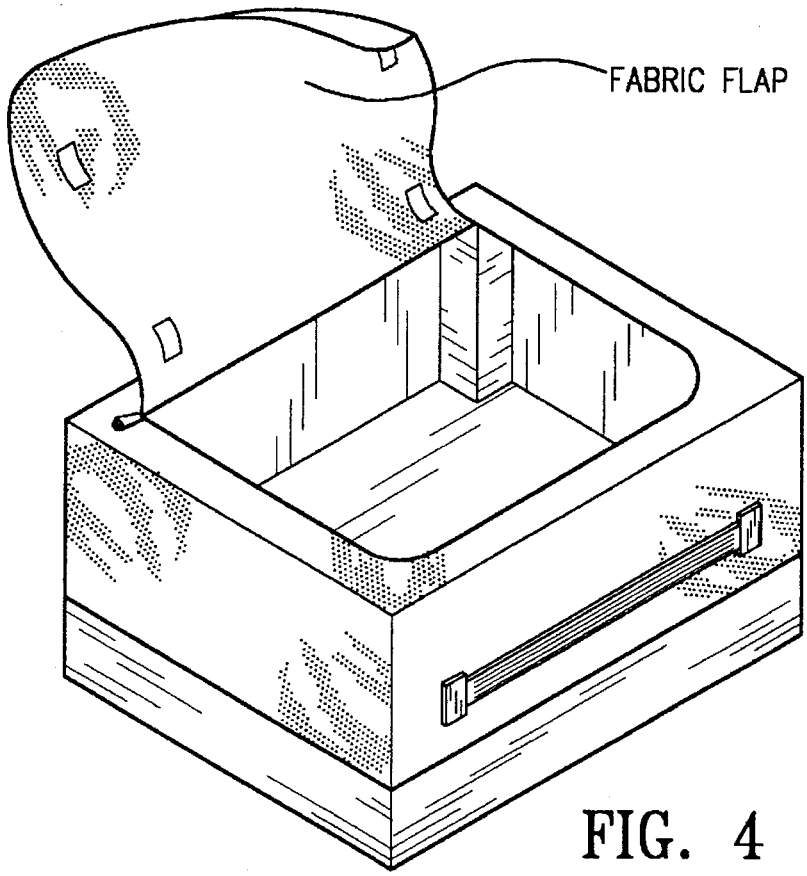
FIG. 4 is a schematic view of the stepcase of FIG. 3 with the fabric flap in the open position.

The aerobic step case of the preferred embodiments has the following features:

1—the platform of the step becomes an outer surface of the case;

2—the overall dimensions of the step, with the legs in the extended mode, determine the internal volume of the case for packing of personal items and other belongings;

3—the other outer surfaces of the case comprise a lightweight flexible fabric material of the type normally used for tote bags other kinds of formless suitcases;

4—this fabric material is attached to the step by either permanent or temporary means, the former by adhesive or staple means, the latter by snap-on and-off type means, depending on the end-use of the case;

5—using the permanent means of attachment of the fabric, the fabric material is designed to be folded under, in back of or away from the step rather than being removed from the step and placed in another location:

6—the fabric material comprises a handle whose location depends on the balancing of the weight distribution required whether in the tote bag, cosmetic case or suitcase mode; and 7—the fabric material comprises a zipper or other slide fastener for access to the contents of the case.

This is the best mode envisioned by the inventor at the time of the filing of this application. Another embodiment is of the more rigid type used in a cosmetic case type application. In this embodiment, the aerobic step while being an outer surface of the case, is hinged to another rigid shell of the same material of construction as the step, and after opening and emptying of of its contents, this outer rigid shell is folded back and the entire case is laid on a floor in a position opposite from that normally used when opening a suitcase.

A further embodiment comprises the aerobic step as the bottom or top or end of a typical larger suitcase configuration.

The foregoing description of the preferred embodiments will so fully reveal the general nature of the invention that others can, by applying current knowledge, readily modify and/or adapt for various applications such embodiments without departing from the generic concept, and, therefore, such modifications should and are intended to be comprehended within the meaning and range of equivalents of the disclosed embodiments. It is to be understood that the phraseology or terminology employed herein is for the purpose of description and not of limitation.

What is claimed is:

1. An aerobic step case comprising:

(a) an aerobic step having a platform and fixed legs;

(b) a flexible fabric material capable of being formed in the shape of a case having the platform as an outer surface of said case; and (c) means for attaching the flexible fabric material to sides of said aerobic step.

2. An aerobic step case comprising:

(a) an aerobic step having a platform;

(b) a flexible fabric material capable of being formed in the shape of a case having the platform as an outer surface of said case; and (c) a removable means for attaching the flexible fabric material to sides of said aerobic step.

3. An aerobic step case comprising:

(a) an aerobic step having a platform;

(b) a rigid material formed in the shape of a case with one end open; and (c) means for attaching the open end of the rigid material to said aerobic step arranged and constructed so that said aerobic step and the rigid material form a carrying case when closed so that the platform of the step becomes an outer surface of said case.

* * * * *